US011203200B2

(12) United States Patent
Niiyama

(10) Patent No.: US 11,203,200 B2
(45) Date of Patent: Dec. 21, 2021

(54) PRINTING APPARATUS, CONTROL METHOD OF PRINTING APPARATUS, AND NON-TRANSITORY COMPUTER-READABLE STORAGE MEDIUM STORING PROGRAM

(71) Applicant: SEIKO EPSON CORPORATION, Tokyo (JP)

(72) Inventor: Shinichiro Niiyama, Sapporo (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/017,997

(22) Filed: Sep. 11, 2020

(65) Prior Publication Data

US 2021/0078318 A1 Mar. 18, 2021

(30) Foreign Application Priority Data

Sep. 13, 2019 (JP) ..... JP2019-167520

(51) Int. Cl.
*B41J 2/045* (2006.01)
*B41J 25/308* (2006.01)

(52) U.S. Cl.
CPC ..... *B41J 2/04505* (2013.01); *B41J 2/04586* (2013.01); *B41J 25/308* (2013.01)

(58) Field of Classification Search
CPC ..... B41J 2/04556; B41J 2/04586; B41J 2/04505; B41J 2/2132; B41J 2/2103; B41J 25/3088; B41J 11/0095; B41J 25/308; B41J 29/377
See application file for complete search history.

(56) References Cited

U.S. PATENT DOCUMENTS 5,541,626 A 7/1996 Hiramatsu et al.
5,847,729 A 12/1998 Takahashi et al.
8,419,144 B2 * 4/2013 Castillo ..... B41J 11/0095 347/8
2008/0238959 A1 * 10/2008 Kato ..... B41J 29/38 347/8

FOREIGN PATENT DOCUMENTS

EP 0566540 10/1993
JP H07-009678 A 1/1995

* cited by examiner

*Primary Examiner* — Thinh H Nguyen
(74) *Attorney, Agent, or Firm* — Workman Nydegger

(57) ABSTRACT

A printer includes: a transport belt; a print head that has a plurality of nozzles for discharging ink, a carriage that mounts the print head thereon, a sensor that detects a non-printable area of the print medium where the print medium placed on the transport belt and the print head are capable of coming into contact with each other; and a control section that performs printing by the print head by dividing the plurality of nozzles into a plurality of nozzle groups in the transport direction, and the control section prints an image indicated by image data assigned to one nozzle group by the other nozzle group different from the one nozzle group, in printing with respect to an adjacent area which is an area of which a length in the transport direction corresponds to a length of a nozzle row in the transport direction of the print head.

11 Claims, 11 Drawing Sheets

PRINTING APPARATUS, CONTROL METHOD OF PRINTING APPARATUS, AND NON-TRANSITORY COMPUTER-READABLE STORAGE MEDIUM STORING PROGRAM

The present application is based on, and claims priority from JP Application Serial Number 2019-167520, filed Sep. 13, 2019, the disclosure of which is hereby incorporated by reference here in its entirety.

BACKGROUND

1. Technical Field

The present disclosure relates to a printing apparatus, a control method of a printing apparatus, and a non-transitory computer-readable storage medium storing a program.

2. Related Art

In the related art, there is known a printing apparatus capable of stopping a printing operation according to an instruction of a user. For example, JP-A-07-009678 discloses a printing apparatus that stops a printing operation when a user presses a stop key on an operation panel. In the JP-A-07-009678, when the user stops the printing operation with the stop key, printing can be performed while avoiding the area of the print medium where the print head and the print medium may come into contact with each other.

In general, in a printing mode in which a plurality of nozzles included in a print head are divided into a plurality of nozzle groups in a transport direction of the print medium, an image which corresponds to the length of the nozzle row is printed in the transport direction, and thus, a plural times of scanning of the carriage and one or more times of transport of the print medium are performed. Therefore, when performing printing in this printing mode on a print medium with which the print head can come into contact, when an attempt is made to perform printing while avoiding an area of the print medium where the print head and the print medium come into contact with each other, in an adjacent area which is adjacent to the area in the transport direction, an image which corresponds to the length of the nozzle row is not printed in the adjacent area which is adjacent to the area in the transport direction, and the print medium may be wasted in the printed product.

SUMMARY

According to an aspect of the present disclosure, there is provided a printing apparatus including: a transport belt that transports a print medium; a print head that has a plurality of nozzles for discharging ink and discharges the ink onto the print medium placed on the transport belt; a carriage that mounts the print head thereon and scans in an intersecting direction that intersects a transport direction of the print medium; a sensor that detects a non-printable area of the print medium where the print medium placed on the transport belt and the print head are capable of coming into contact with each other; and a control section that performs printing by the print head by dividing the plurality of nozzles into a plurality of nozzle groups in the transport direction, in which the control section prints an image indicated by image data assigned to one nozzle group by another nozzle group different from the one nozzle group, in printing with respect to an adjacent area which is an area of which a length in the transport direction corresponds to a length of a nozzle row in the transport direction of the print head, and is a printable area adjacent to the non-printable area detected by the sensor.

In the printing apparatus according to the present disclosure, the control section may print an image indicated by image data assigned to a first nozzle group by a second nozzle group which is adjacent to the first nozzle group and is upstream of the first nozzle group in the transport direction in a state where transport of the transport belt is stopped after the most downstream nozzle group in the transport direction prints an image in the adjacent area, in printing with respect to the adjacent area downstream of the non-printable area in the transport direction.

In the printing apparatus according to the present disclosure, the control section may print an image indicated by image data assigned to a second nozzle group by a first nozzle group which is adjacent to the second nozzle group and is downstream of the second nozzle group in the transport direction, and print an image by the first nozzle group and the second nozzle group in a state where transport of the transport belt is stopped, in printing with respect to the adjacent area upstream of the non-printable area in the transport direction.

In the printing apparatus according to the present disclosure, the control section may perform multi-pass printing in which ink is discharged by the print head a plurality of times with respect to the same raster line that extends in the intersecting direction.

In the printing apparatus according to the present disclosure, the control section may print the adjacent area downstream of the non-printable area in the transport direction by the print head, retract the carriage from a position where the image is printed by the print head and cause the transport belt to transport the print medium until the non-printable area is positioned downstream of the carriage in the transport direction, and perform printing with respect to the adjacent area upstream of the non-printable area in the transport direction by the print head.

In the printing apparatus according to the present disclosure, the control section may change a height of the carriage with respect to the print medium such that a workpiece gap, which is a distance between the print medium and a nozzle surface of the print head, is greater than the workpiece gap during the printing, and retract the carriage.

In the printing apparatus according to the present disclosure, the control section may cause the carriage to scan up to beyond a printing area, which is an outer side of the printing area for printing an image by discharging the ink onto the print medium, and retract the carriage.

In the printing apparatus according to the present disclosure, the sensor may be provided downstream of a placement start position at which the transport belt starts placement of the print medium and upstream of the print head in the transport direction.

In the printing apparatus according to the present disclosure, the print medium may be a fabric, and the non-printable area may include a seam of the fabric.

According to another aspect of the present disclosure, there is provided a control method of a printing apparatus including a transport belt that transports a print medium, a print head that has a plurality of nozzles for discharging ink and discharges the ink onto the print medium placed on the transport belt to print an image, and a carriage that mounts the print head thereon and scans in an intersecting direction that intersects a transport direction of the print medium, in which printing is performed by the print head by dividing the plurality of nozzles included in the print head into a plurality of nozzle groups in the transport direction, the method comprising: detecting, by a sensor, a non-printable area of the print medium where the print medium placed on the transport belt and the print head are capable of coming into contact with each other; and printing an image indicated by image data assigned to one nozzle group by another nozzle group different from the one nozzle group, in printing with respect to an adjacent area which is an area of which a length in the transport direction corresponds to a length of a nozzle row of the print head, and is a printable area adjacent to the non-printable area detected by the sensor in the transport direction.

According to still another aspect of the present disclosure, there is provided a non-transitory computer-readable storage medium storing a program that is executed by a control section of a printing apparatus including a transport belt that transports a print medium, a print head that has a plurality of nozzles for discharging ink and discharges the ink onto the print medium placed on the transport belt to print an image, a carriage that mounts the print head thereon and scans in an intersecting direction that intersects a transport direction of the print medium, a sensor that detects a non-printable area of the print medium where the print medium placed on the transport belt and the print head are capable of coming into contact with each other, and the control section that performs printing by the print head by dividing a plurality of nozzles included in the print head into a plurality of nozzle groups in the transport direction, the program causing the control section to print an image indicated by image data assigned to one nozzle group by another nozzle group different from the one nozzle group, in printing with respect to an adjacent area which is an area of which a length in the transport direction corresponds to a length of a nozzle row of the print head, and is a printable area adjacent to the non-printable area detected by the sensor in the transport direction.

DESCRIPTION OF EXEMPLARY EMBODIMENTS

Figure 1:
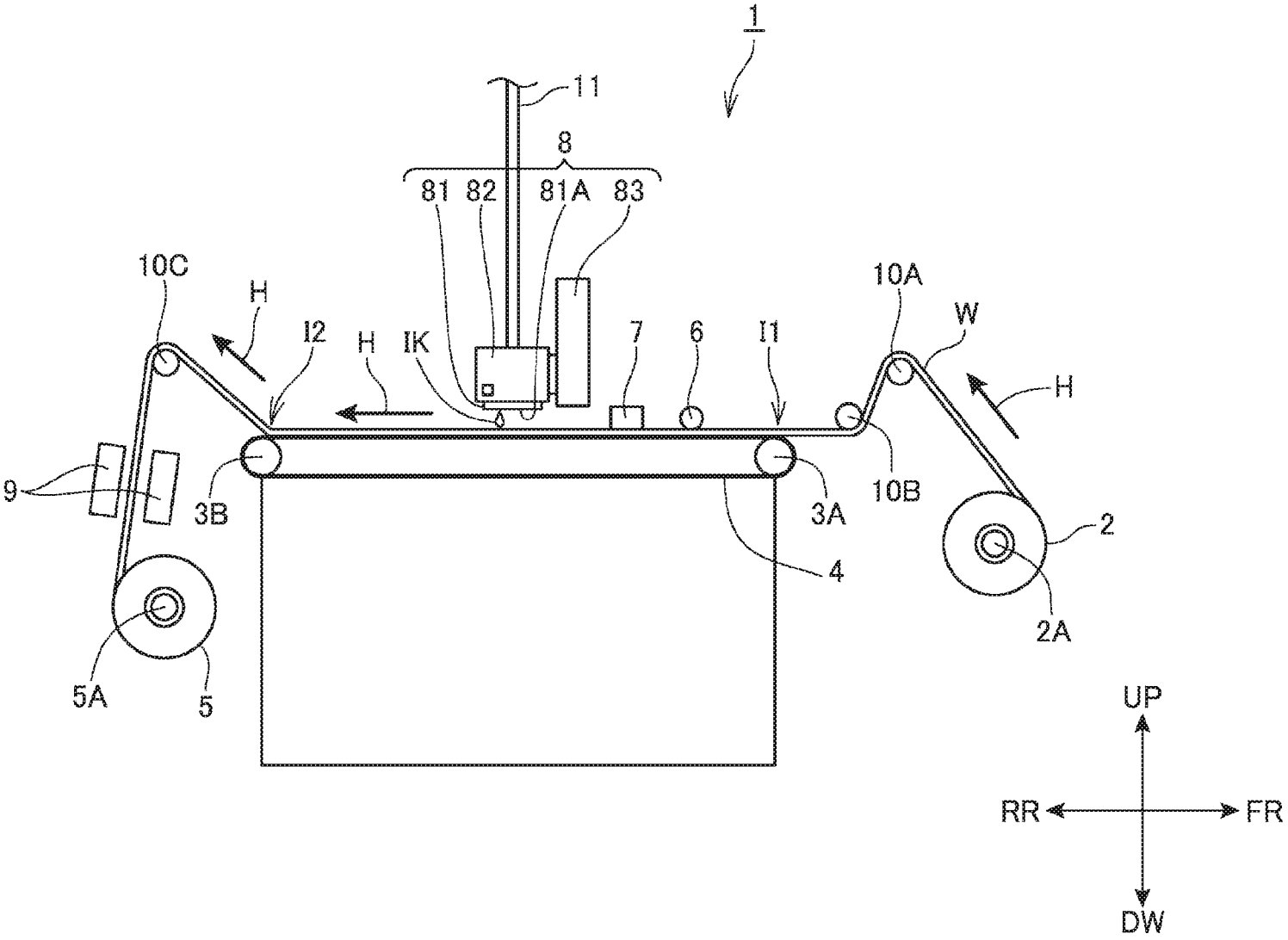
FIG. 1 is a schematic configuration view of a printer.

FIG. 1 is a schematic configuration view of a printer 1. The printer 1 corresponds to an example of a printing apparatus.

Figure 2:
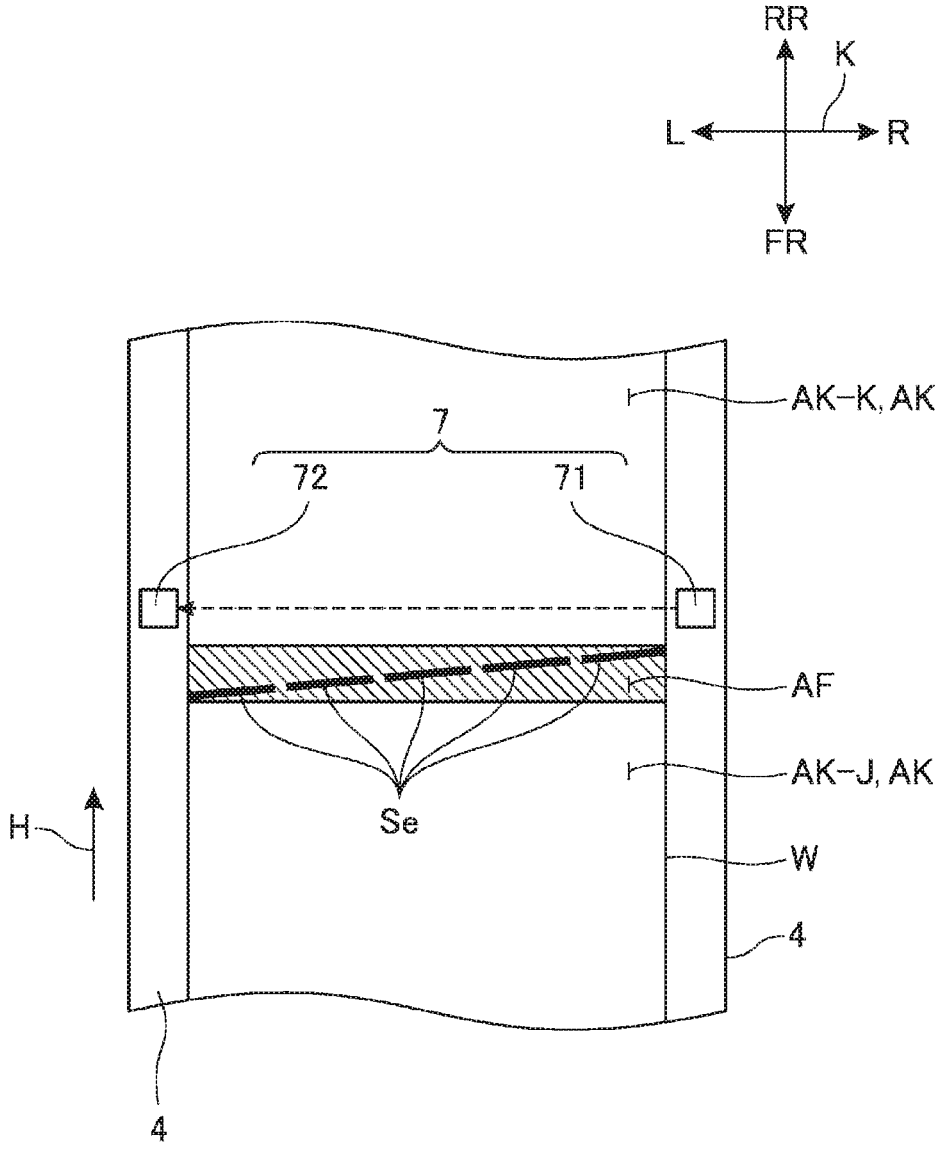
FIG. 2 is a view for describing a sensor.
Figure 3:
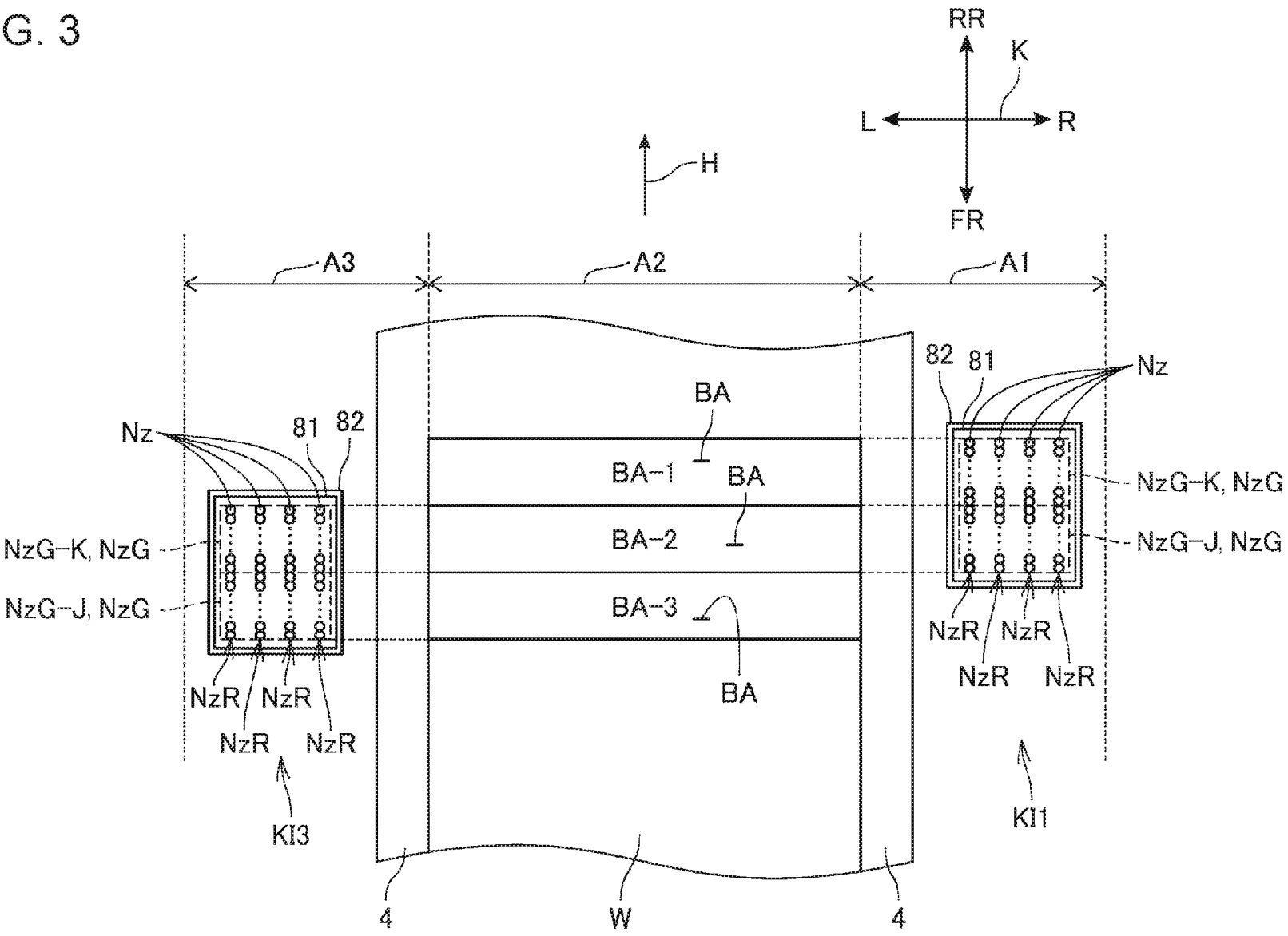
FIG. 3 is a view for describing a printing operation of a carriage, a print head, and a printer.

In FIGS. 1, 2, and 3, the front side of the installed state of the printer 1 is indicated by reference symbol FR, and the rear side of the printer 1 is indicated by reference symbol RR. In addition, in FIGS. 1, 2, and 3, the right side of the printer 1 is indicated by reference symbol R, and the left side of the printer 1 is indicated by reference symbol L. Further, in FIGS. 1, 2, and 3, the upper side of the printer 1 is indicated by reference symbol UP, and the lower side of the printer 1 is indicated by reference symbol DW.

The printer 1 is an ink jet type printing apparatus that includes a print head 81 for discharging an ink IK and discharges the ink IK onto a print medium W to form an image.

The print medium W is configured, for example, such that a plurality of pieces of fabric made of natural fibers or synthetic fibers are joined to each other. The printer 1 is a textile printing machine that performs textile printing onto the print medium W by causing the ink IK to adhere to the print medium W which is a fabric. Therefore, the print medium W is a textile printing material. In the present embodiment, a fabric is used as an example of the print medium W, but, as the print medium W, plain paper, high-quality paper, paper dedicated for ink jet recording such as glossy paper, or the like can also be used in addition to a fabric.

The printer 1 includes a delivery device 2, driven rollers 10A, 10B, and 10C, transport rollers 3A and 3B, a transport belt 4, and a winding device 5. Each of the sections configures a transport mechanism 1011 that transports the print medium W which will be described later.

The delivery device 2 is a device that delivers the long print medium W wound in a roll shape to the transport belt 4. The delivery device 2 is positioned on the most upstream side in a transport direction H of the print medium W. The delivery device 2 rotates a rotation shaft 2A counterclockwise in FIG. 1 to deliver the print medium W set on the rotation shaft 2A onto the transport belt 4 via the driven rollers 10A and 10B.

The transport rollers 3A and 3B are a pair of rollers that drive the endless transport belt 4. For example, the transport roller 3A is a driving roller, and the transport roller 3B is a driven roller. The transport belt 4 is a glue belt with an adhesive layer having adhesiveness formed on the surface thereof. The print medium W delivered from the delivery device 2 is adhesively fixed to the adhesive layer of the transport belt 4 and is transported in the transport direction H together with the transport belt 4. In addition, although the glue belt with an adhesive layer formed on the surface is exemplified as the transport belt 4 of the embodiment, the transport belt 4 is not limited to the adhesive belt and may be, for example, an electrostatic adsorption type belt.

The winding device 5 is a device that winds the print medium W transported by the transport belt 4 via the driven roller 10C. The winding device 5 is positioned on the most downstream side in the transport direction H of the print medium W. The winding device 5 rotates the rotation shaft 5A counterclockwise in FIG. 1 to wind the print medium W printed by the print head 81 in a roll shape around a winding reel set on the rotation shaft 5A.

The printer 1 includes a pressing roller 6. The pressing roller 6 is provided downstream of a placement start position I1 where the transport belt 4 starts the placement of the print medium W and upstream of a sensor 7 which will be described later, in the transport direction H. The print medium W placed on the transport belt 4 is pressed against the transport belt 4 by the pressing roller 6. Accordingly, the printer 1 can cause the print medium W to reliably adhere to the adhesive layer formed on the surface of the transport belt 4, and can suppress a case where the print medium W placed on the transport belt 4 rises up from the transport belt 4. The pressing roller 6 is configured to be capable of reciprocating along the transport direction H in order to suppress a case where the print medium W has a roller trace.

The printer 1 includes the sensor 7. The sensor 7 is provided downstream of the pressing roller 6 and upstream of a printing unit 8, in the transport direction H.

FIG. 2 is a view for describing the sensor 7.

The sensor 7 is a sensor that detects an area of the print medium W where the print medium W placed on the transport belt 4 and the print head 81 which will be described later can come into contact with each other. In the following description, the area will be referred to as "non-printable area" and given reference symbol "AF". The sensor 7 is an optical sensor and includes a light emitting section 71 and a light receiving section 72. The light emitting section 71 and the light receiving section 72 are provided so as to pinch the print medium W placed on the transport belt 4 in the left-right direction. The light emitting section 71 is provided such that the optical axis of the emitted light is in the left-right direction, and the light receiving section 72 is provided so as to be able to receive the light emitted by the light emitting section 71. Further, the light emitting section 71 and the light receiving section 72 are set to have a height to be positioned between the nozzle surface 81A of the print head 81 and the print medium W adhered to the transport belt 4 in the up-down direction. The sensor 7 detects the presence or absence of an object that blocks the light emitted by the light emitting section 71 based on the amount of light received by the light receiving section 72.

The non-printable area AF of the embodiment is an area including a seam Se of the fabric. In the print medium W, the seam Se is a place where the end portions of different fabrics are joined to each other, and is thicker than the area other than the seam Se. Therefore, in the print medium W placed on the transport belt 4, the seam Se projects above the area other than the seam Se. Accordingly, the sensor 7 can detect the non-printable area AF including the seam Se by blocking the light emitted from the light emitting section 71 by the seam Se. The sensor 7 outputs a detection value indicating that the seam Se is being detected to the control section 100, which will be described later, while the seam Se is being detected.

In the following description, an area other than the non-printable area AF on the print medium W will be referred to as "printable area" and given reference symbol "AK". Further, in the following description, the printable area AK that is upstream of the non-printable area AF in the transport direction H will be referred to as "upstream printable area" and given reference symbol "AK-J". Further, in the following description, the printable area AK that is downstream of the non-printable area AF in the transport direction H will be referred to as "downstream printable area" and given reference symbol "AK-K". In addition, the upstream printable area AK-J corresponds to the downstream printable area AK-K with reference to the non-printable area AF positioned upstream of the upstream printable area AK-J in the transport direction H.

Returning to the description of FIG. 1, the printer 1 includes the printing unit 8. The printing unit 8 is provided downstream of the sensor 7 and upstream of a placement end position 12 where the print medium W is separated from the transport belt 4, in the transport direction H.

The printing unit 8 includes the carriage 82.

The print head 81 is mounted on the carriage 82. The print head 81 reciprocates on the print medium W in the intersecting direction K that intersects the transport direction H together with the carriage 82. In the embodiment, the intersecting direction K is a direction orthogonal to the transport direction H and is a left-right direction of the printer 1.

Here, a printing operation of the carriage 82, the print head 81, and the printer 1 will be described with reference to FIG. 3.

FIG. 3 is a view for describing the printing operation of the carriage 82, the print head 81, and the printer 1.

The carriage 82 reciprocates along a guide shaft (not illustrated). The guide shaft is a shaft that extends in the intersecting direction K and is provided at a position that opposes the transport belt 4. The carriage 82 reciprocates in the intersecting direction K along the guide shaft together with a gap adjusting mechanism 83 including a cam and the like.

As described above, the print head 81 is mounted on the carriage 82. In addition, various devices other than the print head 81 may be mounted on the carriage 82.

The print head 81 receives the supply of the ink IK from an ink storage mechanism (not illustrated) via an ink supply path 11 and discharges the ink IK onto the print medium W placed on the transport belt 4. The ink storage mechanism is a mechanism that stores the ink IK, and includes, for example, an ink cartridge and an ink tank. The print head 81 has a plurality of nozzle rows NzR, in which a plurality of nozzles Nz for discharging the ink IK are arranged in the transport direction H, arranged in the intersecting direction K on the surface that opposes the print medium W. For example, in order to discharge cyan (C), magenta (M), yellow (Y), and black (K) inks IK, the print head 81 has four nozzle rows NzR corresponding to each of the four colors.

The ink IK discharged by the print head 81 is not limited to the inks IK of the above-described colors, and may be inks IK such as light cyan, light magenta, orange, green, gray, light gray, white, metallic or the like. In addition to the ink IK, the print head 81 may be configured to discharge a penetrant onto the print medium W. The penetrant is a liquid that promotes penetration of the ink IK, which has adhered to the surface of the print medium W, to the back surface. In this case, the print head 81 discharges the penetrant toward the print medium W at the same time as the discharge of the ink IK or at a timing different from the discharge of the ink IK.

The carriage 82 is positioned in any of a non-printing area A1, a printing area A2, or a non-printing area A3 in the intersecting direction K. In addition, the non-printing areas A1 and A3 correspond to the outside of the printing area, which is an outer side of the printing area A2 in the intersecting direction K.

The non-printing area A1 is an area in which the print head 81 cannot discharge the ink IK for the purpose of image printing. The non-printing area A1 is an area adjacent to the printing area A2 on the right of the printing area A2. The non-printing area A1 is an area that does not include the print medium W placed on the transport belt 4. Therefore, the print medium W is not positioned at a position corresponding to the print head 81 mounted on the carriage 82 positioned in the non-printing area A1. Note that a case where the carriage 82 is positioned in the non-printing area A1 means a case where the nozzle row NzR positioned on the leftmost among the nozzle rows NzR included in the print head 81 is positioned in the non-printing area A1 in the intersecting direction K. A maintenance mechanism that executes maintenance with respect to the print head 81 may be provided in the non-printing area A1.

The printing area A2 is an area in which the print head 81 discharges the ink IK for the purpose of image formation. The printing area A2 is an area pinched between the non-printing areas A1 and A3 in the intersecting direction K and is adjacent to the non-printing areas A1 and A3.

The non-printing area A3 is an area in which the print head 81 cannot discharge the ink IK for the purpose of image printing. The non-printing area A3 is an area adjacent to the printing area A2 on the left of the printing area A2. The non-printing area A3 is an area that does not include the print medium W placed on the transport belt 4. Therefore, the print medium W is not positioned at a position corresponding to the print head 81 mounted on the carriage 82 positioned in the non-printing area A3. Note that a case where the carriage 82 is positioned in the non-printing area A3 means a case where the nozzle row NzR positioned on the rightmost among the nozzle rows NzR included in the print head 81 is positioned in the non-printing area A3 in the intersecting direction K. A maintenance mechanism that executes maintenance with respect to the print head 81 may be provided in the non-printing area A3 instead of the non-printing area A1.

When discharging the ink IK onto the print medium W to print an image, the carriage 82 scans in the intersecting direction K starting from scan start positions KI1 and KI3. The scan start position KI1 is a position in the intersecting direction K and is a position in the non-printing area A1 when the carriage 82 starts scanning to the left. The carriage 82 positioned at the scan start position KI1 is positioned in the non-printing area A1. The scan start position KI3 is a position in the intersecting direction K and is a position in the non-printing area A3 when the carriage 82 starts scanning to the right. The carriage 82 positioned at the scan start position KI3 is positioned in the non-printing area A3.

The printer 1 of the embodiment executes multi-pass printing. The multi-pass printing is a printing mode in which an image that extends in the transport direction H corresponding to the length of the nozzle row NzR included in the print head 81 is printed in a plurality of passes. Here, the pass means one scan of the carriage 82 to the right or left. In the embodiment, the multi-pass printing is exemplified in which an image that extends in the transport direction H corresponding to the length of the nozzle row NzR included in the print head 81 is printed in two passes.

In the multi-pass printing, the nozzle rows NzR are divided in the transport direction H into a plurality of nozzle groups NzG. The divided nozzle group NzG has the same number of nozzles Nz as that of the nozzles Nz of the other divided nozzle groups NzG. The number of divisions corresponds to the number of passes when the image that extends in the transport direction H corresponding to the length of the nozzle row NzR included in the print head 81 is printed. In the embodiment, the nozzle rows are divided into two nozzle groups NzG.

In the following description, among the nozzle groups NzG divided into two in the transport direction H, the nozzle group NzG on the upstream side in the transport direction H will be referred to as "upstream nozzle group" and given reference symbol "NzG-J". The upstream nozzle group NzG-J corresponds to an example of the second nozzle group. In addition, in the following description, among the nozzle groups NzG divided into two in the transport direction H, the nozzle group NzG on the downstream side in the transport direction H will be referred to as "downstream nozzle group" and given reference symbol "NzG-K". The downstream nozzle group NzG-K corresponds to an example of the first nozzle group.

For example, it is assumed that the carriage 82 is positioned at the scan start position KI1. When printing on the print medium W, the carriage 82 scans leftward and moves to the scan start position KI3. The print head 81 discharges an appropriate amount of ink IK from an appropriate nozzle at an appropriate timing in the printing area A2 while the carriage 82 scans to the left. According to this, the downstream nozzle group NzG-K prints an image in a division length printing area BA indicated by reference numeral BA−1. Further, the upstream nozzle group NzG-J prints an image in the division length printing area BA indicated by reference numeral BA−2. The division length printing area BA is an area that extends in the transport direction H corresponding to the length of one divided nozzle group NzG. Note that the reference numerals BA−1, BA−2, and BA−3 are the reference numerals for identifying the division length printing area BA in FIG. 3, and are not actually printed on the print medium W.

After the carriage 82 moves to the scan start position KI3, the transport belt 4 transports the print medium W in the transport direction H by a distance that corresponds to the length of the one divided nozzle group NzG in the transport direction H according to the control of the control section 100.

Next, after transport by the transport belt 4, the carriage 82 switches the scanning direction to the right and scans from the scan start position KI3 toward the scan start position KI1. The print head 81 discharges an appropriate amount of ink IK from an appropriate nozzle at an appropriate timing in the printing area A2 while the carriage 82 scans to the right. According to this, the downstream nozzle group NzG-K prints an image in a division length printing area BA indicated by reference numeral BA−2. Further, the upstream nozzle group NzG-J prints an image in the division length printing area BA indicated by reference numeral BA−3.

Here, the downstream nozzle group NzG-K discharges the ink IK to a raster line formed by the upstream nozzle group NzG-J in the previous pass. The raster line is a dot row that extends in the intersecting direction K. For example, the most upstream nozzle Nz of the downstream nozzle group NzG-K discharges the ink IK to the raster line formed by the most upstream nozzle Nz of the upstream nozzle group NzG-J. Each nozzle Nz of the downstream nozzle group NzG-K discharges the ink IK at a position different from or at the same position as the dot formed by the upstream nozzle group NzG-J with respect to the corresponding raster line formed by each nozzle Nz of the upstream nozzle group NzG-J. According to this, the resolution of the image printed in the division length printing area BA indicated by reference numeral BA−2 and the discharge amount of the ink IK can be increased.

In this manner, the printer 1 according to the embodiment repeatedly performs the scanning of the carriage 82 leftward, the transporting of the divided one nozzle group NzG by the length in the transport direction H, and the scanning of the carriage 82 rightward, as many times as necessary for printing.

Returning to the description of FIG. 1, the printing unit 8 includes the gap adjusting mechanism 83. The gap adjusting mechanism 83 is a mechanism that adjusts a workpiece gap that is a distance between the print medium W and a nozzle surface 81A of the print head 81. The gap adjusting mechanism 83 is coupled to the carriage 82 and adjusts the workpiece gap by moving the carriage 82 in the up-down direction according to the control of the control section 100.

The printer 1 includes a drying unit 9. The drying unit 9 is provided upstream of the winding device 5 and downstream of the driven roller 10C in the transport direction H. In addition, the drying unit 9 may not be provided downstream of the driven roller 10C as long as the drying unit 9 is provided upstream of the winding device 5 and downstream of the print head 81 in the transport direction H. The drying unit 9 has, for example, a chamber that accommodates the print medium W and a heater that is disposed inside the chamber, and dries the undried ink IK on the print medium W by the heat of the heater.

Next, the functional configuration of the printer 1 will be described.

Figure 4:
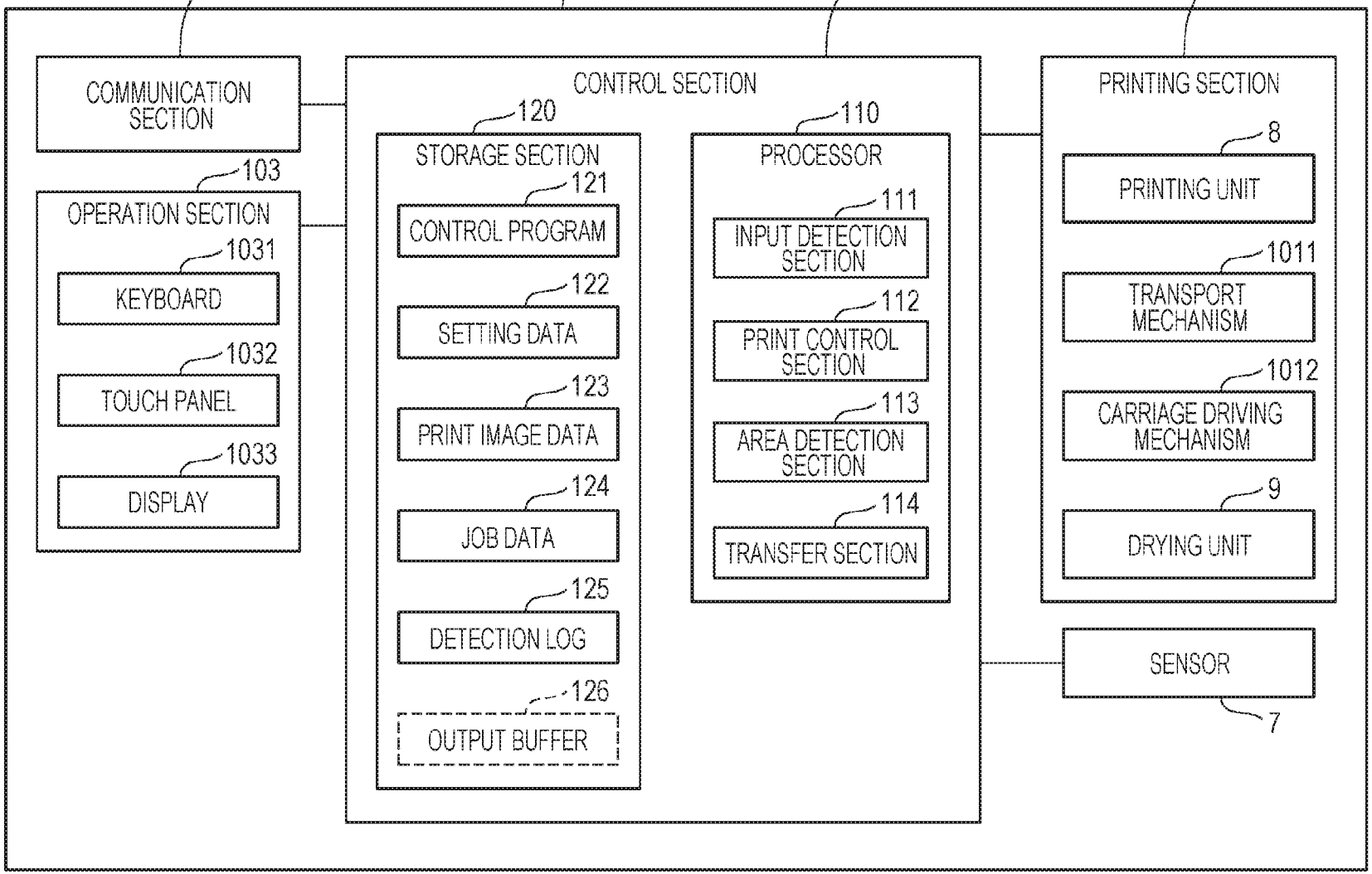
FIG. 4 is a block diagram illustrating a functional configuration of the printer.

FIG. 4 is a block diagram illustrating the functional configuration of the printer 1.

The printer 1 includes the control section 100.

The control section 100 includes a processor 110 that executes programs, such as a CPU or an MPU, and a storage section 120, and controls each section of the printer 1. The control section 100 executes various types of processing by cooperation of hardware and software such that the processor 110 reads a control program 121 stored in the storage section 120 and executes the processing. The control program 121 corresponds to an example of the program. The processor 110 functions as an input detection section 111, a print control section 112, an area detection section 113, and a transfer section 114 by reading and executing the control program 121. Details of the functional blocks will be described later.

The storage section 120 has a storage area that stores a program executed by the processor 110 and data processed by the processor 110. The storage section 120 stores the control program 121 executed by the processor 110 and setting data 122 including various setting values related to the operation of the printer 1. The storage section 120 has a non-volatile storage area that stores programs or data in a non-volatile manner. In addition, the storage section 120 may include a volatile storage area and may be configured to temporarily store a program executed by the processor 110 or data to be processed.

The printer 1 includes a printing section 101.

The printing section 101 includes the printing unit 8, the transport mechanism 1011, a carriage driving mechanism 1012, and the drying unit 9. The transport mechanism 1011 is a mechanism for transporting the print medium W, and in addition to the delivery device 2, the driven rollers 10A, 10B, and 10C, the transport rollers 3A and 3B, the transport belt 4, and the winding device 5, the transport mechanism 1011 includes a motor that drives theses members. The carriage driving mechanism 1012 is a mechanism that reciprocates the carriage 82 in the scanning direction, and includes, for example, a motor as a driving source, a guide member that guides the movement of the carriage 82, a gear or a link that transmits the power of the motor to the carriage 82, and the like.

The printer 1 includes a communication section 102.

The communication section 102 is configured of communication hardware such as a connector and an interface circuit according to a predetermined communication standard, and communicates with an external apparatus of the printer 1 according to the control of the control section 100. The external apparatus of the printer 1 is, for example, a computer or a server apparatus. When the communication section 102 receives print image data 123 from the external apparatus, the control section 100 stores the received print image data 123 in the storage section 120. When the communication section 102 receives job data 124 for instructing printing from the external apparatus, the control section 100 stores the received job data 124 in the storage section 120.

The printer 1 includes an operation section 103.

The operation section 103 includes a keyboard 1031, a touch panel 1032, and a display 1033. The operation section 103 may be configured to include only one of the keyboard 1031 and the touch panel 1032. The display 1033 corresponds to an example of the display section. The keyboard 1031 has a plurality of keys operated by an operator, and outputs operation data indicating the operated keys to the control section 100. The display 1033 has a display screen such as a liquid crystal display (LCD) and displays an image according to the control of the control section 100. The touch panel 1032 is disposed so as to overlap the display screen of the display 1033, detects a touch operation on the display screen, and outputs operation data indicating the touch position to the control section 100.

The sensor 7 is coupled to the control section 100. The sensor 7 outputs the detection value to the control section 100.

The control section 100 includes the input detection section 111, the print control section 112, the area detection section 113, and the transfer section 114.

The storage section 120 stores the control program 121, the setting data 122, the print image data 123, the job data 124, and a detection log 125. An output buffer 126 is formed in a predetermined storage area of the storage section 120.

The input detection section 111 detects the input operation of the operator based on the operation data input from the keyboard 1031 and the touch panel 1032, and acquires the input content. When the data received via the communication section 102 is analyzed and the image data 123 is received, the input detection section 111 stores the print image data 123 in the storage section 120. Further, when the job data 124 which is the data related to print job IJ is received, the input detection section 111 stores the job data 124 in the storage section 120.

The print image data 123 is data of an image printed by the print head 81 on the print medium W, and the storage section 120 can store a plurality of pieces of print image data 123.

The print control section 112 controls the printing section 101 according to the job data 124, and causes the printing section 101 to execute printing on the print medium W. The print control section 112 generates pass data PD based on the job data 124 and stores the generated pass data PD in the output buffer 126. The pass data PD is data for discharging the ink IK from the print head 81 in one pass. The print control section 112 generates the pass data PD for each pass and stores the generated pass data PD in the output buffer 126.

The output buffer 126 is a buffer that temporarily stores the pass data PD output from the print control section 112, and is formed in a predetermined storage area of the storage section 120.

The job data 124 is data for the print control section 112 to execute printing in units of a job group 130 including one or a plurality of print jobs IJ. Here, the job group 130 will be described.

Figure 5:
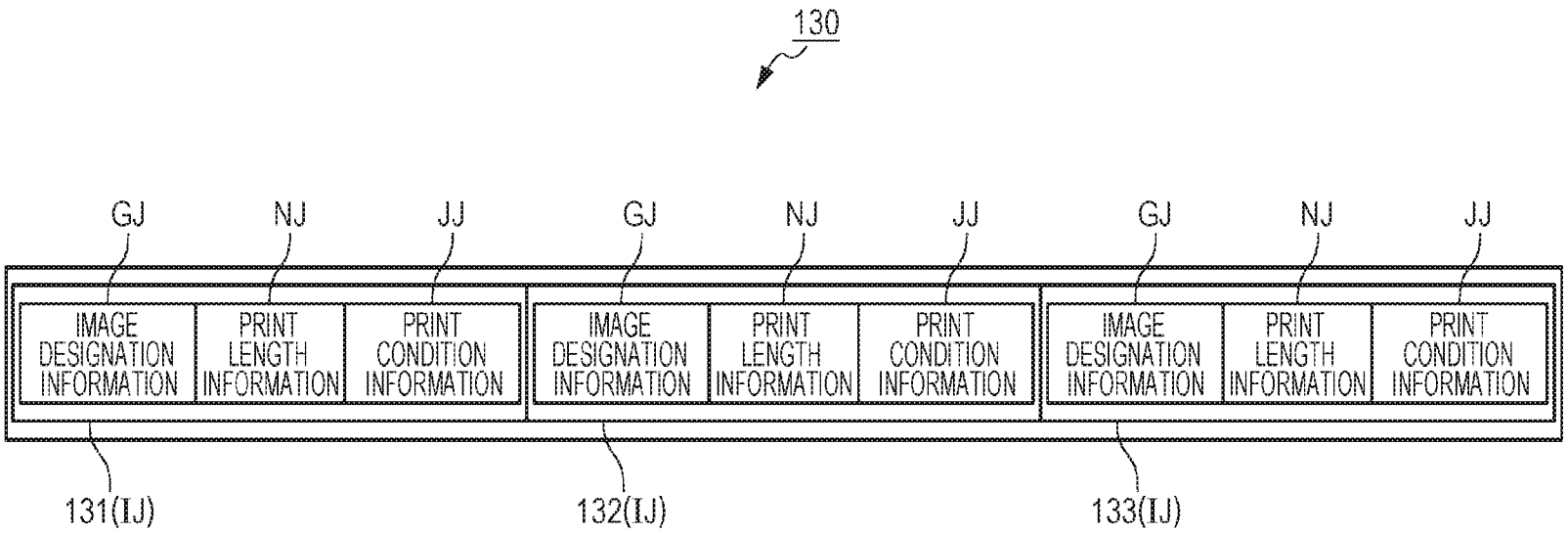
FIG. 5 is a schematic diagram illustrating a configuration of a job group.

FIG. 5 is a schematic view illustrating the configuration of the job group 130.

There is no limit to the number of print jobs IJ included in the job group 130 executed by the printer 1, and the job group 130 illustrated in FIG. 5 exemplifies a case including three print jobs 131, 132, and 133. The arrangement order of the print jobs 131, 132, and 133 in the job group 130 indicates the order in which the print control section 112 executes printing. Therefore, the print jobs 131, 132, and 133 are executed by the print control section 112 in the order of arrangement in the job group 130.

The print job 131 includes image designation information GJ, print length information NJ, and print condition information JJ. The image designation information GJ is information for designating an image to be printed on the print medium W, and designates any of the print image data 123 stored in the storage section 120. For example, when the storage section 120 stores each of the plurality of pieces of print image data 123 as one file, the image designation information GJ includes a file name or a file path that designates any one of the print image data 123.

The print length information NJ is information for designating the print length that is the length for printing the image designated by the image designation information GJ. The print length designates the size of the print medium W on which the image of the print job 131 is printed in the transport direction H, for example, in units of meters. When the print length is greater than the image size of the print image data 123, the print control section 112 repeats the image of the print image data 123 and prints the image on the print medium W. Therefore, the print image data 123 may be data of an image smaller than the print length. Further, the print image data 123 may be data of an image smaller than the size of the print medium W in the intersecting direction K, that is, the width of the print medium W. In this case, the print control section 112 also repeatedly prints the image of the print image data 123 in the width direction of the print medium W.

The print condition information JJ is information indicating print conditions when the print head 81 prints an image. For example, the print condition indicated by the print condition information JJ includes the print resolution of the image printed by the print head 81 or the workpiece gap WG. Further, the print condition indicated by the print condition information JJ may include print density, information for designating the ink discharge amount per unit area, and the like.

The print jobs 131, 132, and 133 included in the job group 130 include the image designation information GJ, the print length information NJ, and the print condition information JJ, respectively. Therefore, the print control section 112 can print different images in the print jobs 131, 132, and 133 included in the job group 130 with different print lengths and print conditions.

The print control section 112 continuously executes the print jobs 131, 132, and 133 included in the job group 130. Therefore, different images designated by each of the print jobs 131, 132, and 133 are connected and printed on the long print medium W. Therefore, for example, when printing a plurality of images in order, a blank does not occur at the position where the images are switched or the printing operation does not stop, and thus, the print control section 112 can reduce the waste of the print medium W while suppressing deterioration of productivity of the printer 1, and can efficiently performing printing.

The job data 124 can be configured to include the data of the plurality of job groups 130.

The print control section 112 refers to the job data 124 and acquires the data of the job group 130 designated by the operation of the operation section 103. The print control section 112 prints the print jobs 131, 132, and 133 included in the designated job group 130 in the order included in the job group 130.

The area detection section 113 determines the presence or absence of the non-printable area AF in the print medium W based on the detection value input from the sensor 7. In addition, when it is determined that the print medium W has the non-printable area AF, the area detection section 113 detects the position of the non-printable area AF on the print medium W and the length of the non-printable area AF in the transport direction H based on the detection value input from the sensor 7. The area detection section 113 stores the detection log 125 including information indicating the position of the detected non-printable area AF and information indicating the length of the detected non-printable area AF in the transport direction H, in the storage section 120. In addition to these pieces of information, the detection log 125 includes, for example, various pieces of information such as information indicating the start time at which the sensor 7 starts detecting the non-printable area AF.

For example, when detecting the length of the non-printable area AF in the transport direction H, the area detection section 113 counts the period during which the sensor 7 detects the seam Se based on the detection value input from the sensor 7. In addition, the area detection section 113 does not perform the count even when the sensor 7 detects the seam Se while the transport belt 4 stops the transport of the print medium W. Then, the area detection section 113 calculates the transport distance of the transport belt 4 corresponding to the counted period, and detects the calculated transport distance as the length of the non-printable area AF in the transport direction H. Note that this detection method is merely an example, and any detection method can be adopted.

Further, for example, when the detecting the position of the non-printable area AF on the print medium W, the area detection section 113 detects the position of the non-printable area AF on the print medium W based on the print start time of the job group 130, the transport distance of the transport belt 4 after the print of the job group 130 is started, the start time at which the sensor 7 starts detection of the non-printable area AF, and the length of the detected non-printable area AF in the transport direction H. Note that this detection method is merely an example, and any detection method can be adopted.

The transfer section 114 transfers the pass data PD stored in the output buffer 126 to the printing unit 8 in the order of storage based on the instruction from the print control section 112. For example, the transfer section 114 transfers the pass data PD to the printing unit 8 at an appropriate timing based on an instruction from the print control section 112 such that the printing unit 8 does not wait for the transfer of the pass data PD. The print head 81 of the printing unit 8 discharges the ink IK based on the pass data PD transferred from the transfer section 114.

Next, the operation of the printer 1 will be described.

Figure 6:
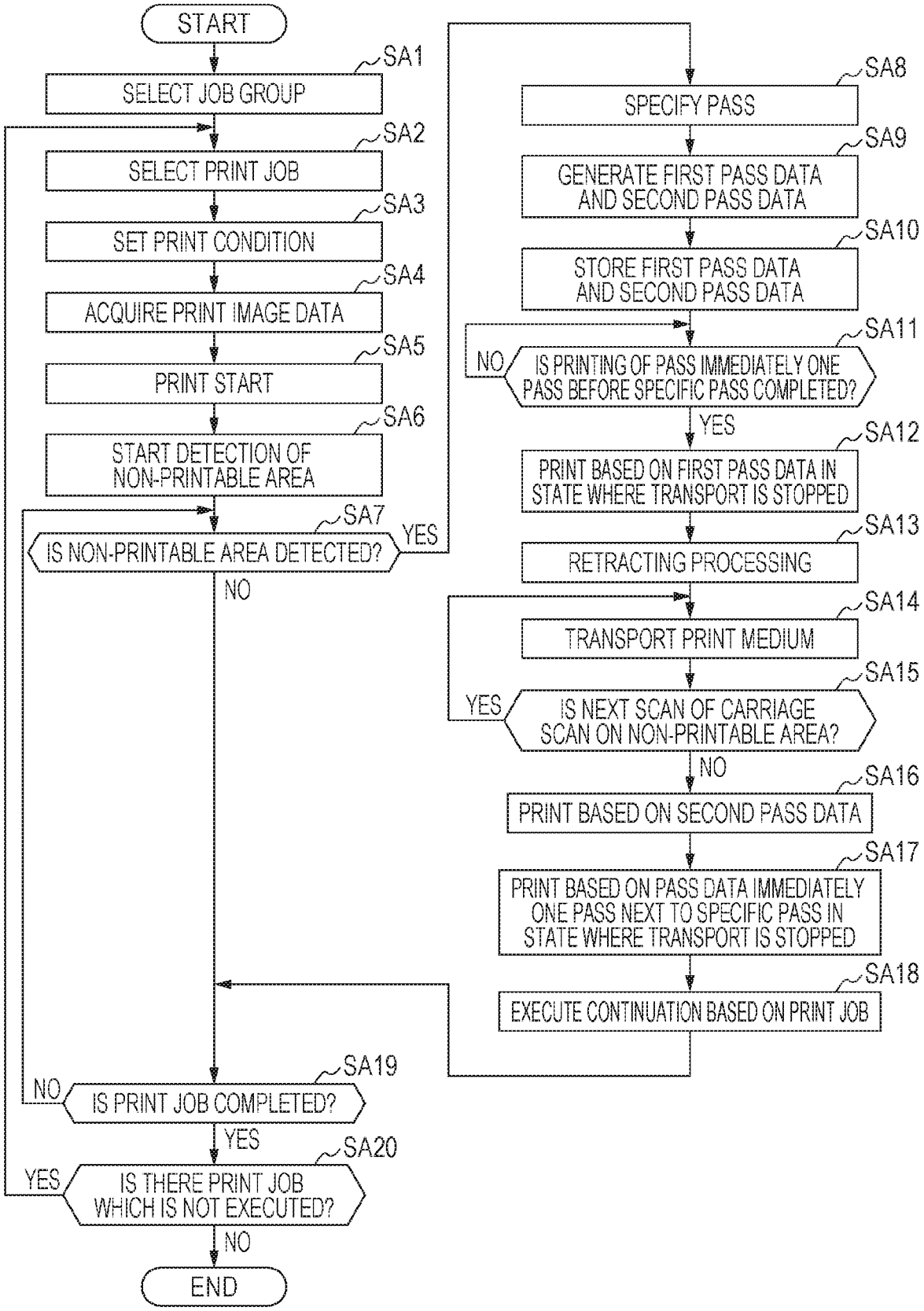
FIG. 6 is a flowchart illustrating an operation of the printer.

FIG. 6 is a flowchart illustrating the operation of the printer 1 and illustrates the operation related to printing on the print medium W.

The print control section 112 selects the job group 130 to be executed from the job groups 130 included in the job data 124 according to the input operation detected by the operation section 103 (step SA1).

Next, the print control section 112 selects one print job IJ from the print jobs IJ included in the job group 130 selected in step SA1 according to the execution order of the print job IJ (step SA2).

Next, the print control section 112 acquires the print condition information JJ indicating the print condition of the print job IJ to be executed, and sets the print condition indicated by the acquired print condition information JJ (step SA3). Subsequently, the print control section 112 acquires the print image data 123 designated by the image designation information GJ from the storage section 120 (step SA4).

Next, the print control section 112 controls the printing section 101 to start printing on the print medium W (step SA5). After the start of printing, the print control section 112 starts generation of the pass data PD for each pass and stores the pass data PD in the output buffer 126 for each pass. In addition, after the start of the printing, the transfer section 114 transfers the pass data PD stored in the output buffer 126 to the printing unit 8 in the order of storage based on the instruction of the print control section 112.

Next, the area detection section 113 starts the detection of the non-printable area AF on the print medium W based on the detection value output by the sensor 7 in response to the start of printing (step SA6).

The area detection section 113 determines whether or not the non-printable area AF on the print medium W was detected based on the detection value output by the sensor 7 (step SA7).

When it is determined that the area detection section 113 is not detecting the non-printable area AF (step SA7: NO), the print control section 112 determines whether or not the print job IJ is completed (step SA19).

Meanwhile, when it is determined that the area detection section 113 detected the non-printable area AF (step SA7: YES), the print control section 112 specifies the number of pass for scanning over the detected non-printable area AF after the start of printing (step SA8). More specifically, in step SA8, the print control section 112 specifies the number of the pass on which the uppermost nozzle Nz moves on the non-printable area AF detected by the sensor 7 in the transport direction H after the start of printing. For example, the print control section 112 executes the processing of step SA8, for example, based on the number of passes counted after the start of printing, the transport distance of the print medium W transported by the transport mechanism 1011 after the start of printing, the position of the print head 81 in the transport direction H, the length of the nozzle row NzR, and the length of the non-printable area AF detected by the area detection section 113 in the transport direction H.

In the following description, the pass specified in step SA8 is referred to as "specific pass". Further, in the following description, the pass data PD of the specific pass will be referred to as "specific pass data" and given reference symbol "PD-T".

Here, in the embodiment, it is assumed that the print control section 112 generates the specific pass data PD-T and stores the generated specific pass data PD-T in the output buffer 126 during the processing of step SA9.

Next, the print control section 112 generates two pass data PD, that is, first pass data PD−1 and second pass data PD−2, from the specific pass data PD-T (step SA9).

Figure 7:
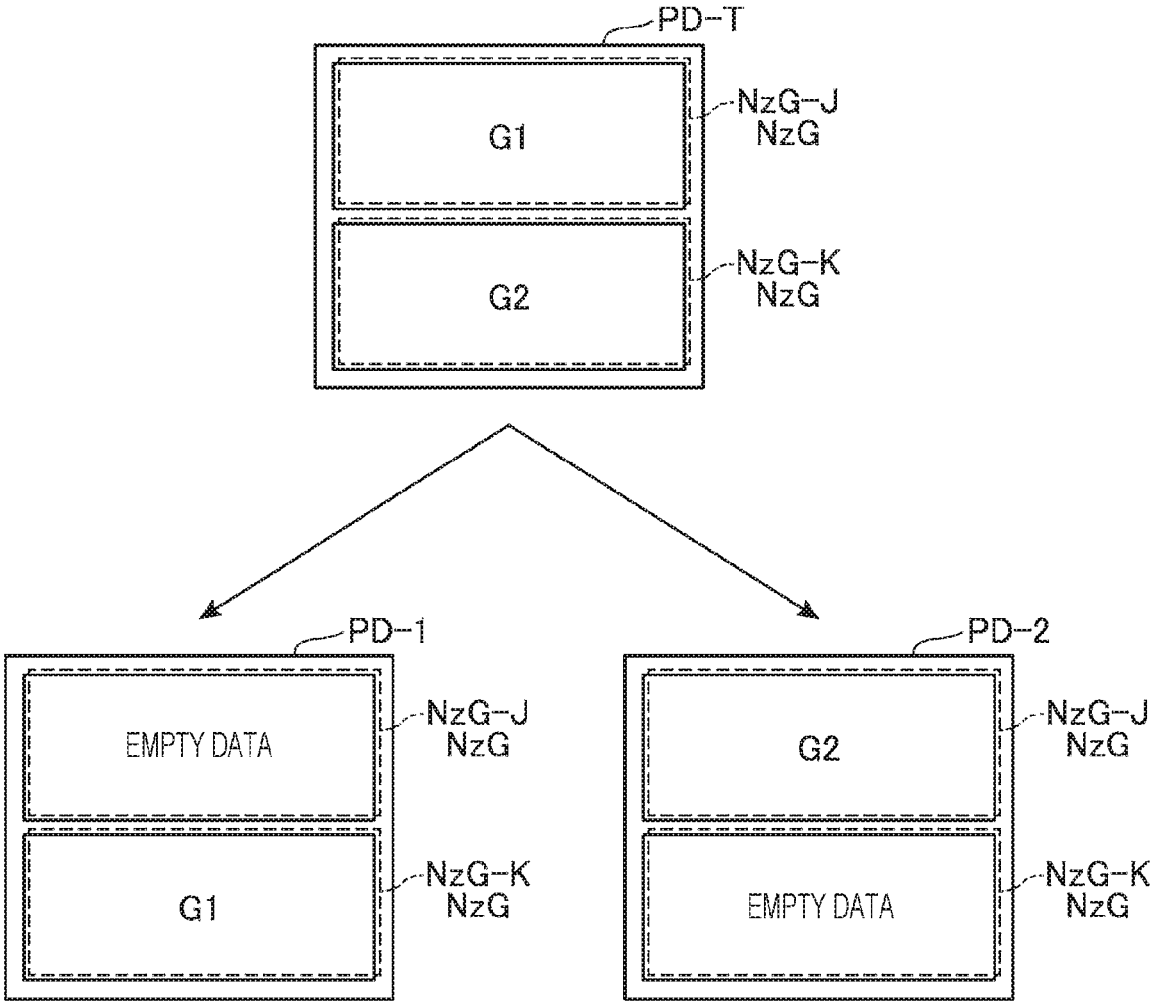
FIG. 7 is a schematic view illustrating specific pass data, first pass data, and second pass data.

FIG. 7 is a schematic view illustrating the specific pass data PD-T, the first pass data PD−1, and the second pass data PD−2.

FIG. 7 schematically illustrates that the specific pass data PD-T, the first pass data PD−1, and the second pass data PD−2 illustrated in FIG. 7 are image data assigned to the upstream nozzle group NzG-J and the downstream nozzle group NzG-K. In FIG. 7, for convenience of understanding the assignment of image data, the nozzle group NzG is illustrated by being overlapped with the pass data PD by a dotted line. Note that the dotted lines that overlap the pass data PD illustrated in FIGS. 8 to 11 are also for the convenience of understanding the assignment of image data.

The specific pass data PD-T illustrated in FIG. 7 is data in which the image data of an image G1 is assigned to the upstream nozzle group NzG-J such that the upstream nozzle group NzG-J prints the image G1, and the image data of an image G2 is assigned to the downstream nozzle group NzG-K such that the downstream nozzle group NzG-K prints the image G2.

The print control section 112 generates the first pass data PD−1 in which the image data assigned to the upstream nozzle group NzG-J in the specific pass data PD-T is assigned to the downstream nozzle group NzG-K. In the first pass data PD−1, the image data is not assigned to the upstream nozzle group NzG-J, but empty data indicating that the ink IK is not discharged is assigned. In a case of FIG. 7, in the first pass data PD−1, the image data of the image G1 assigned to the upstream nozzle group NzG-J in the specific pass data PD-T is assigned to the downstream nozzle group NzG-K, and the empty data is assigned to the upstream nozzle group NzG-J.

The print control section 112 generates the second pass data PD−2 in which the image data assigned to the downstream nozzle group NzG-K in the specific pass data PD-T is assigned to the upstream nozzle group NzG-J. In the second pass data PD−2, the image data is not assigned to the downstream nozzle group NzG-K, but empty data is assigned. In a case of FIG. 7, in the second pass data PD−2, the image data of the image G2 assigned to the downstream nozzle group NzG-K in the specific pass data PD-T is assigned to the upstream nozzle group NzG-J, and the empty data is assigned to the downstream nozzle group NzG-J.

Returning to the description of FIG. 6, the print control section 112 stores the first pass data PD−1 and the second pass data PD−2 generated in step SA9 in the output buffer 126 in this order instead of the specific pass data PD-T (step SA10).

In the embodiment, since the specific pass data PD-T is stored in the output buffer 126 during the processing of step SA10, the print control section 112 erases the specific pass data PD-T and the pass data PD stored in the output buffer 126 after the specific pass data PD-T, from the output buffer 126. Then, the print control section 112 stores the first pass data PD−1 and the second pass data PD−2 generated in step SA9 in the output buffer 126 in this order instead of the specific pass data PD-T.

When the processing of step SA10 is executed, the print control section 112 generates the pass data PD for the passes after the specific pass, and sequentially stores the generated pass data PD in the output buffer 126.

Next, the print control section 112 determines whether or not the printing based on the pass data PD immediately one pass before the specific pass is completed (step SA11).

When it is determined that the printing based on the pass data PD immediately one pass before the specific pass was completed (step 11: YES), the print control section 112 executes the printing based on the first pass data PD−1 by the printing section 101 in a state where the transport of the print medium W by the transport belt 4 is stopped (step SA12). After the transfer of the first pass data PD−1, the transfer section 114 does not transfer the second pass data PD−2 until a negative determination is made in step SA15.

The processing of step SA12 will be specifically described with reference to FIGS. 8 and 9.

Figure 8:
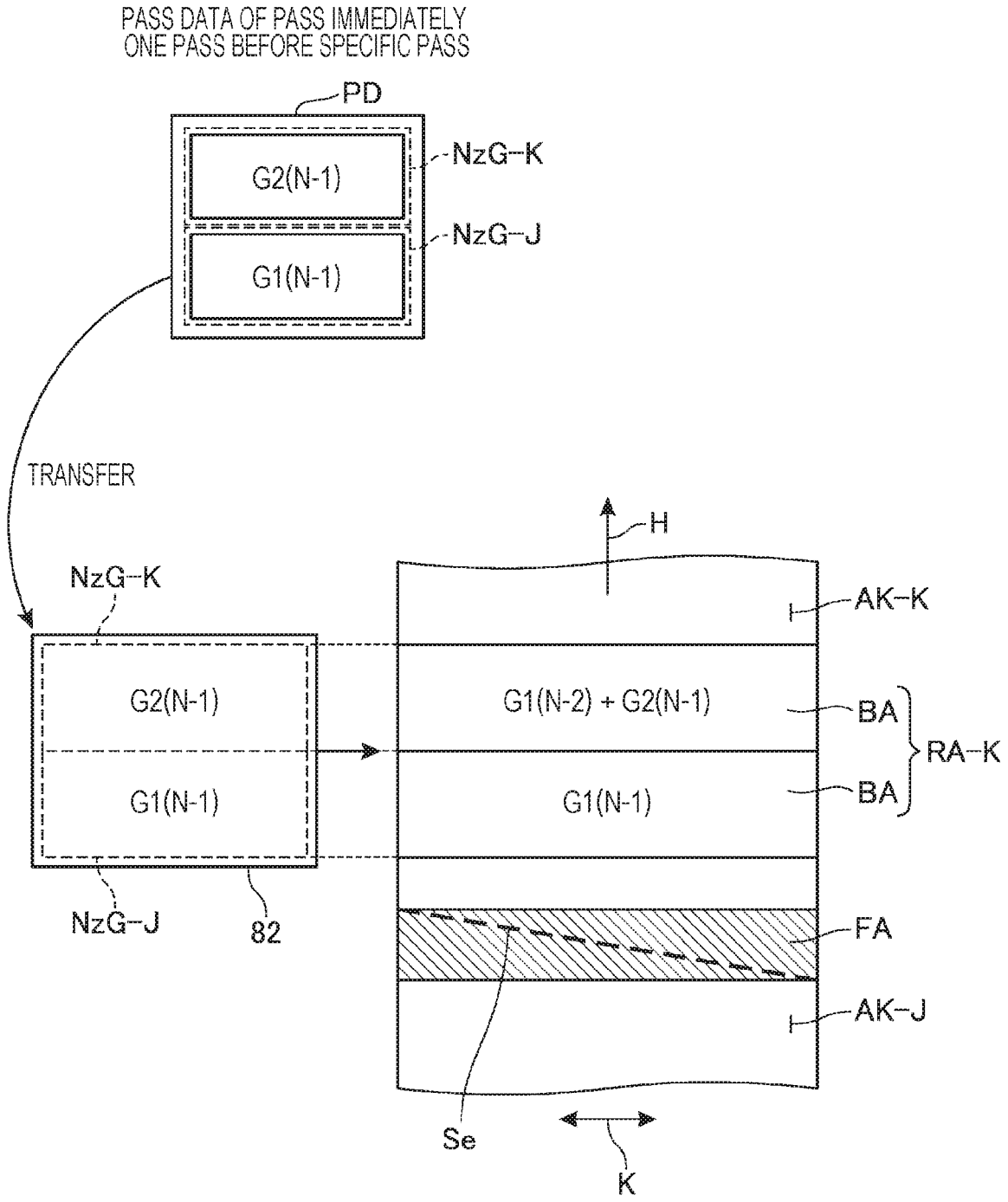
FIG. 8 is a view for describing printing in a downstream adjacent area.
Figure 9:
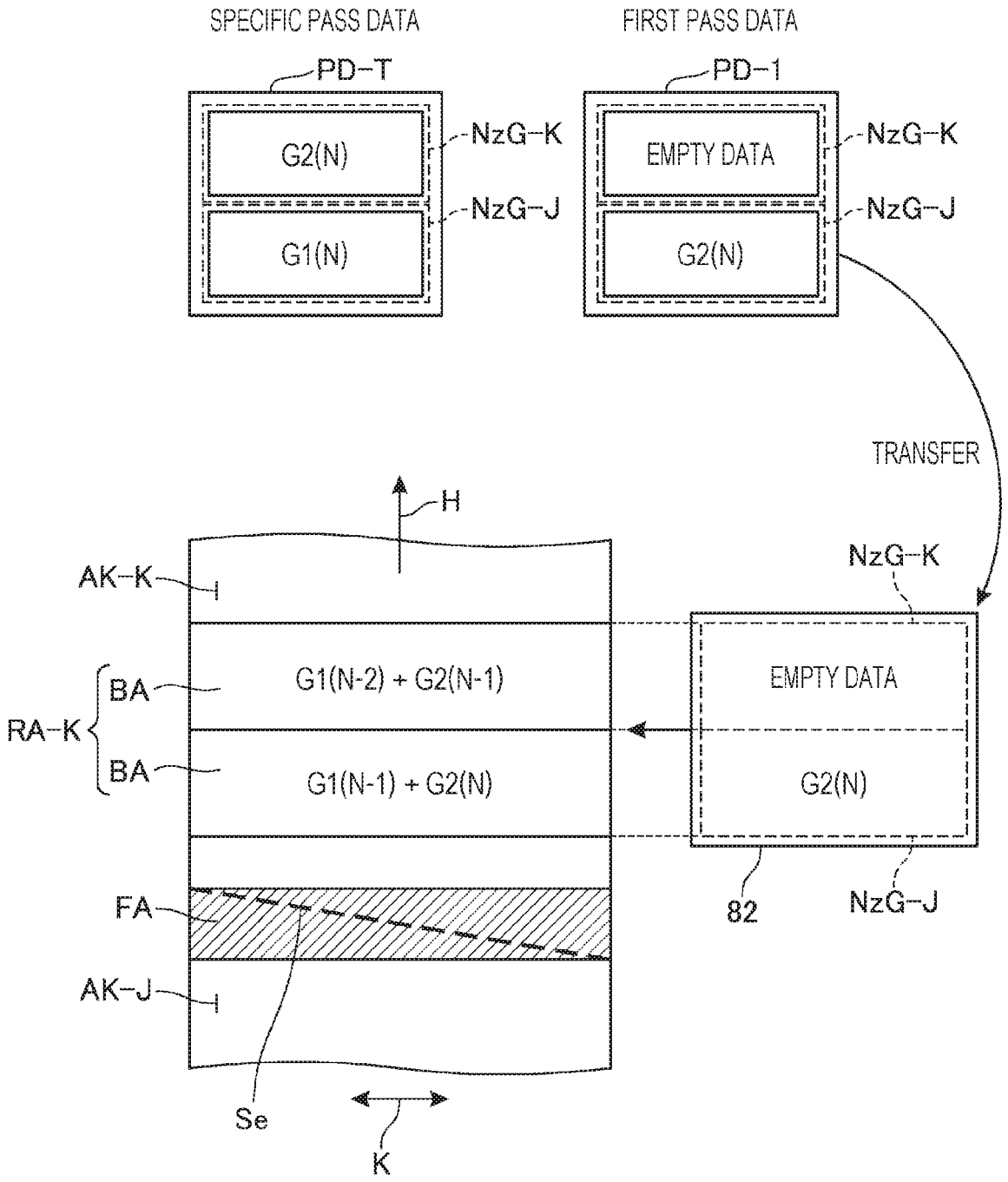
FIG. 9 is a view for describing printing in the downstream adjacent area.

FIGS. 8 and 9 are views for describing the printing in a downstream adjacent area RA-K. Further, FIG. 9 illustrates a continuation of the printing illustrated in FIG. 8.

The downstream adjacent area RA-K is an adjacent area RA downstream of the non-printable area AF detected by the sensor 7 in the transport direction H, and is an area within the downstream printable area AK-K. The adjacent area RA is a printable area of which the length in the transport direction H corresponds to the length of the nozzle row NzR in the transport direction H and which is adjacent to the non-printable area AF detected by the sensor 7 in the transport direction H. In the embodiment, "adjacent" referred here also includes a case where the areas are adjacent to each other in the transport direction H by a distance shorter than the length of the nozzle row NzR in the transport direction H.

In FIGS. 8 and 9, it is assumed that the specific pass is the N-th pass after the start of printing. In addition, in FIGS. 10 and 11 which will be referred to later, it is assumed that the specific pass is the N-th pass after the start of printing.

In FIG. 8, in the pass data PD immediately one pass before the specific pass, the image data of the image G1 (N−1) is assigned to the upstream nozzle group NzG-J, and the image data of the image G2 (N−1) is assigned to the downstream nozzle group NzG-K. Here, "N−1" means that the pass immediately one pass before the specific pass is the (N−1)th pass after the start of printing.

When the printing section 101 executes the printing based on the pass data PD immediately one pass before the specific pass, as illustrated in FIG. 8, the print head 81 prints the image G1 (N−1) in the division length printing area BA on the upstream side in the downstream adjacent area RA-K. Further, the print head 81 prints the image G2 (N−1) in the division length printing area BA on the downstream side in the downstream adjacent area RA-K.

In the downstream adjacent area RA-K where the printing is performed in the pass immediately one pass before the specific pass, the image G1 (N−2) is printed in the division length printing area BA on the downstream side in the pass immediately two passes before the specific pass. In FIG. 8, the image G1 (N−2) is an image printed by the upstream nozzle group NzG-J in the (N−2)th pass after the start of printing. When the printing is performed in the downstream adjacent area RA-K by the pass immediately one pass before the specific pass, in the division length printing area BA on the downstream side of the downstream adjacent area RA-K, the image G1 (N−1) is printed overlapping the image G1 (N−2) printed by the (N−2)th pass. Accordingly, in the division length printing area BA on the downstream side in the downstream adjacent area RA-K, the image printing is completed by pass immediately one pass before the specific pass.

As illustrated in FIG. 9, when printing is performed based on the pass data PD immediately one pass before the specific pass, the print control section 112 executes the printing by the printing section 101 based on the first pass data PD−1.

In FIG. 9, in the specific pass data PD−T, the image data of the image G1 (N) is assigned to the upstream nozzle group NzG-J, and the image data of the image G2 (N) is assigned to the downstream nozzle group NzG-K. Therefore, in FIG. 9, in the first pass data PD−1, the image data of the image G2 (N) is assigned to the upstream nozzle group NzG-J, and the empty data is assigned to the downstream nozzle group NzG-K.

The print control section 112 executes the printing by the printing section 101 based on the first pass data PD−1 in a state where the transport by the transport belt 4 is stopped after the printing based on the pass data PD immediately one pass before the specific pass. Accordingly, the print head 81 prints the image G2 (N) in the division length printing area BA on the upstream side in the downstream adjacent area RA-K and does not print the image in the division length printing area BA on the downstream side. Here, the upstream nozzle group NzG-J discharges the ink IK to the same raster line as the raster line printed by the pass data immediately one pass before the specific pass, and prints the image G2 (N) in the division length printing area BA on the upstream side in the downstream adjacent area RA-K.

When the printing is performed in the downstream adjacent area RA-K based on the first pass data PD−1, in the division length printing area BA on the upstream side of the downstream adjacent area RA-K, the image G2 (N) is printed overlapping the image G1 (N−1) printed by the (N−1)th pass. Accordingly, the image printing onto the downstream adjacent area RA-K is completed by the printing based on the first pass data PD−1.

Returning to the description of FIG. 6, the print control section 112 executes retracting processing of retracting the carriage 82 from the position where the print head 81 prints an image on the print medium W (step SA13). In the embodiment, the print control section 112 executes any of first retracting processing or second retracting processing.

First Retracting Processing

In the first retracting processing, the print control section 112 controls the gap adjusting mechanism 83, moves the carriage 82 upward such that the workpiece gap is greater than the workpiece gap during printing, and changes the height of the carriage 82 with respect to the print medium W.

Second Retracting Processing

In the second retracting processing, the carriage 82 is positioned at any of the scan start positions KI1 and KI3. In addition, when the scanning direction of the carriage 82 in the processing of step SA12 is the right direction, the print control section 112 causes the carriage 82 to scan so as to be positioned at the scan start position KI1. Then, when the scanning direction of the carriage 82 in the processing of step SA12 is the left direction, the print control section 112 causes the carriage 82 to scan so as to be positioned at the scan start position KI3.

After executing the retracting processing, the print control section 112 transports the print medium W by the transport belt 4 (step SA14). When the first retracting processing is executed, the print control section 112 repeats the scanning of the carriage 82 and the transport of the print medium W by the transport belt 4 while stopping execution of the print job IJ until a negative determination is made in step SA15. When the second retracting processing is executed, the print control section 112 continues the transport of the print medium W by the transport belt 4 in a state where the execution of the print job IJ is stopped and the scanning of the carriage 82 is stopped until a negative determination is made in step SA15.

Next, the print control section 112 determines whether or not the next scan of the carriage 82 is a scan on the non-printable area AF (step SA15). More specifically, in step SA11, the print control section 112 determines whether or not the next scan of the carriage 82 is the scan in which the most downstream nozzle Nz moves on the non-printable area AF in the transport direction H.

When it is determined that the next scan of the carriage 82 is the scan on the non-printable area AF (step SA15: YES), the print control section 112 executes the processing of steps SA14 again. In other words, the print control section 112 repeats the scanning of the carriage 82 and the transport of the print medium W by the transport belt 4 while stopping execution of the print job IJ until a negative determination is made in step SA15.

Meanwhile, when the print control section 112 determines that the next scan of the carriage 82 is not the scan on the non-printable area AF (step SA15: NO), the transfer section 114 is caused to restart the transfer of the pass data PD and the printing section 101 is caused to execute the printing based on the second pass data PD−2 (step SA16).

Next, the print control section 112 causes the printing section 101 to execute the printing based on the pass data PD of the pass which is one pass next to the specific pass in a state where the transport by the transport belt 4 is stopped (step SA17).

Next, the print control section 112 executes the continuation of the pass data PD executed in step SA17 based on the print job IJ (step SA18).

Here, the processing of steps SA16 and SA17 will be specifically described with reference to FIGS. 10 and 11.

Figure 10:
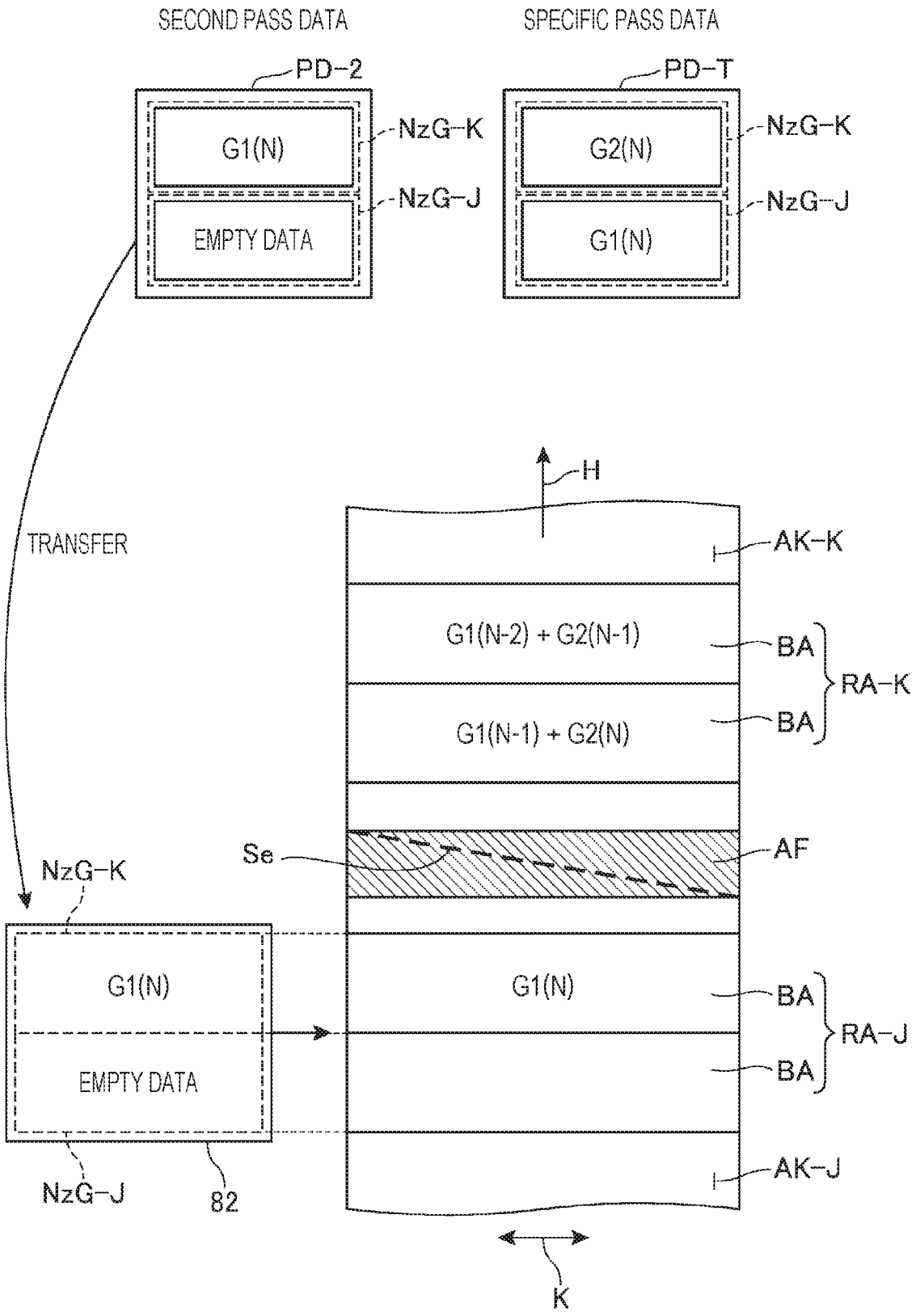
FIG. 10 is a view for describing printing in an upstream adjacent area.
Figure 11:
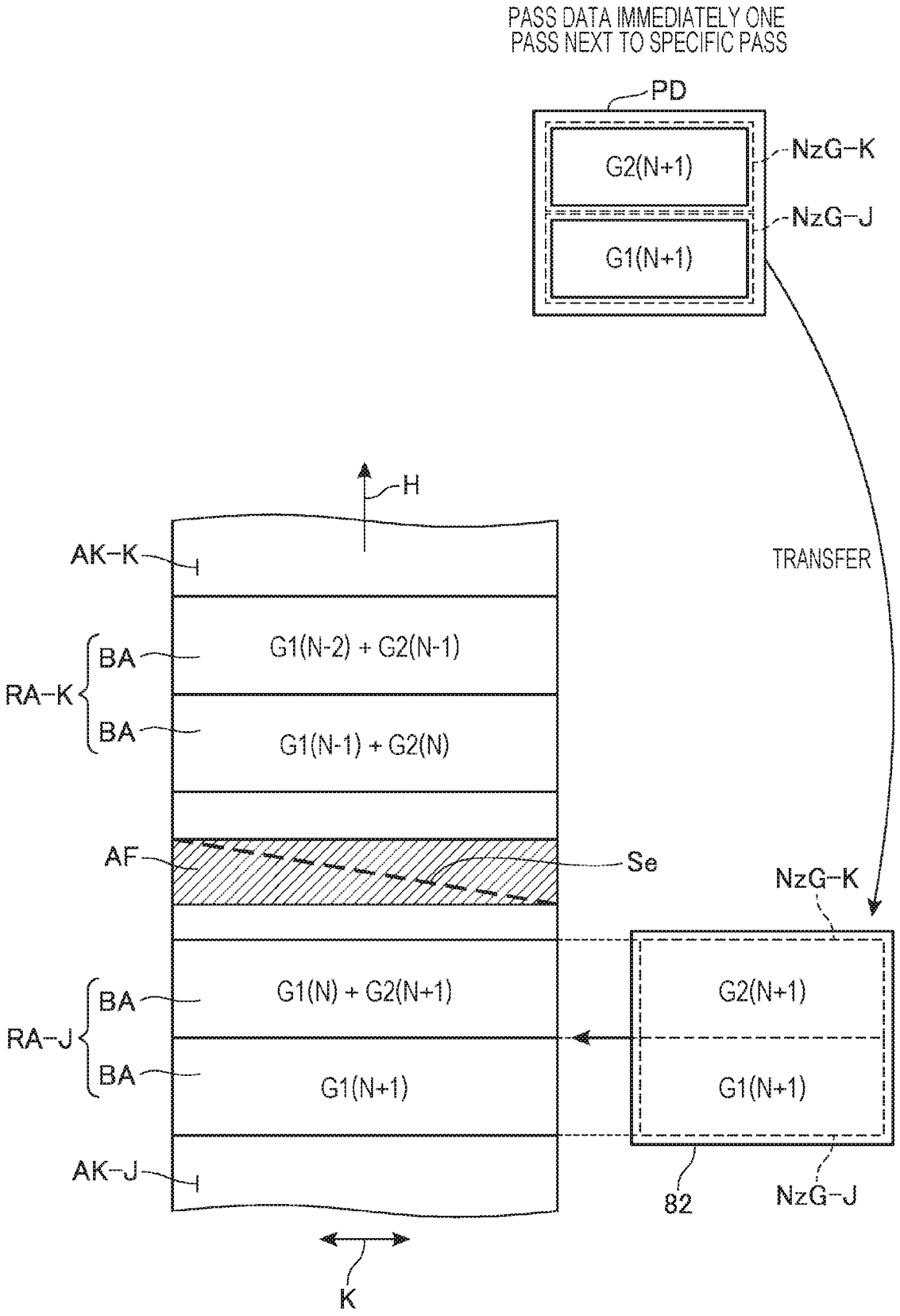
FIG. 11 is a view for describing printing in the upstream adjacent area.

FIGS. 10 and 11 are views for describing the printing in an upstream adjacent area RA-J.

FIG. 10 illustrates the continuation of the printing illustrated in FIG. 9, and FIG. 11 illustrates the continuation of the printing illustrated in FIG. 10. Accordingly, in FIGS. 10 and 11, the specific pass is the N-th pass after the start of printing.

The upstream adjacent area RA-J is an adjacent area RA upstream of the non-printable area AF detected by the sensor 7 in the transport direction H, and is an area within the upstream printable area AK-J.

In FIG. 10, in the specific pass data PD, the image data of the image G1 (N) is assigned to the upstream nozzle group NzG-J, and the image data of the image G2 (N) is assigned to the downstream nozzle group NzG-K. Therefore, in FIG. 10, in the second pass data PD−2, the image data of the image G1 (N) is assigned to the downstream nozzle group NzG-K, and the empty data is assigned to the upstream nozzle group NzG-J.

The print control section 112 prints the image G1 (N) in the division length printing area BA on the downstream side in the upstream adjacent area RA-J by executing the printing by the printing section 101 based on the second pass data PD−2. Meanwhile, the print control section 112 does not print an image in the division length printing area BA on the upstream side in the upstream adjacent area RA-J.

In FIG. 11, when the printing is performed based on the specific pass data PD−T, the print control section 112 causes the printing section 101 to execute the printing based on the pass data PD which is one pass next to the specific pass.

In FIG. 11, in the pass data PD immediately one pass next to the specific pass, the image data of the image G1 (N+1) is assigned to the upstream nozzle group NzG-J, and the image data of the image G2 (N+1) is assigned to the downstream nozzle group NzG-K.

The print control section 112 executes the printing by the printing section 101 based on the pass data PD which is one pass next to the specific pass in a state where the transport by the transport belt 4 is stopped after the printing based on the second pass data PD−2. Accordingly, the print head 81 prints the image G2 (N+1) in the division length printing area BA on the downstream side in the upstream adjacent area RA-J and prints the image G1 (N+1) in the division length printing area BA on the upstream side. In other words, the downstream nozzle group NzG-K discharges the ink IK to the same raster line as the raster line printed by the second pass data PD−2, and prints the image G2 (N+2) in the division length printing area BA on the downstream side in the upstream adjacent area RA-J.

When the printing is performed in the upstream adjacent area RA-J based on the pass data PD, in the division length printing area BA on the upstream side of the upstream adjacent area RA-J, the image G2 (N+1) is printed overlapping the image G1 (N) printed by the second pass data PD−2. Accordingly, the printing based on the pass data PD completes the image printing on the division length printing area BA on the downstream side of the upstream adjacent area RA-J.

After the pass which is the second pass after the specific pass, the print control section 112 executes the printing based on the pass data PD in the printing mode illustrated in FIG. 3 while transporting by the transport belt 4.

Returning to the description of FIG. 6, the print control section 112 determines whether or not the print job IJ is completed (step SA19). When the printing of the print job IJ is not completed (step SA19: NO), the control section 100 returns to step SA7.

In the processing of step SA8 from the second time, when the number of pass is specified, two times of scanning of the carriage 82 by the first pass data PD−1 and the second pass data PD−2 may be specified to be regarded as one pass, and the pass may be specified by adding the increased number of passes.

When the print job is completed (step S19: YES), the print control section 112 determines whether or not there is a print job IJ that has not been executed in the job group 130 selected in step SA1 (step SA20). When there is the print job IJ that has not been executed (step SA20: YES), the control section 100 returns to step SA2. When there is no print job IJ that has not been executed (step SA20: NO), the control section 100 ends this processing. Note that the printed product obtained by the operation of FIG. 6 is longer than the total print length of all print jobs IJ by the number of non-printable areas AF.

The effect of the operation of FIG. 6 will be described.

When the image data assignment to the nozzle group NzG is not changed in the printing on the downstream adjacent area RA-K, in the division length printing area BA on the upstream side of the downstream adjacent area RA-K, as illustrated in FIG. 9, the image G2 (N) that was scheduled to be printed by the specific pass cannot be printed overlapping the image G1 (N−1). This is because the print head 81 scans over the non-printable area AF by the specific pass. Therefore, in this case, the image printing is not completed in the division length printing area BA on the downstream side of the downstream adjacent area RA-KJ illustrated in FIG. 9, and the print medium W is wasted in the printed product as much as the division length printing area BA.

Further, when the image data assignment to the nozzle group NzG is not changed in the printing on the upstream adjacent area RA-J, in the division length printing area BA on the downstream side of the upstream adjacent area RA-J, as illustrated in FIG. 11, the image G1 (N) that was scheduled to be printed by the specific pass cannot be printed. This is because, when an attempt is made to print in the division length printing area BA on the downstream side of the upstream adjacent area RA-J by the upstream nozzle group NzG-J, the print head 81 can scan the non-printable area AF. Therefore, in this case, the image printing is not completed in the division length printing area BA on the downstream side of the upstream adjacent area RA-J illustrated in FIG. 11, and the print medium W is wasted in the printed product as much as the division length printing area BA.

As a result, in both adjacent areas RA, the print medium W is wasted in the printed product by at least the length of the nozzle row NzR in the transport direction H. In particular, the printer 1 of the embodiment is a textile printing machine, and since the print head 81 is relatively greater than the print head that can print only standard paper, for example, more waste of the print medium W occurs in the printed product.

However, since the printer 1 of the embodiment changes the image data assigned to the nozzle group NzG when printing the adjacent area RA, the image printing can be completed in the adjacent area RA, and the occurrence of the waste of the print medium W in the printed product can be suppressed.

As described above, the printer 1 includes: the transport belt 4 that transports the print medium W; the print head 81 that has a plurality of nozzles N for discharging the ink IK and discharges the ink IK onto the print medium W placed on the transport belt 4; the carriage 82 that mounts the print head 81 thereon and scans in the intersecting direction K that intersects the transport direction H of the print medium W; the sensor 7 that detects the non-printable area AF of the print medium W where the print medium W placed on the transport belt 4 and the print head 81 are capable of coming into contact with each other; and the control section 100 that performs printing by the print head 81 by dividing the plurality of nozzles Nz into the plurality of nozzle groups NzG in the transport direction H. The control section 100 prints the image indicated by the image data assigned to one nozzle group NzG by the other nozzle group NzG different from the one nozzle group NzG, in the printing with respect to the adjacent area RA which is an area of which the length in the transport direction H corresponds to the length of the nozzle row NzR in the transport direction H of the print head 81, that is, a printable area adjacent to the non-printable area AF detected by the sensor 7 in the transport direction H.

In the control method of the printer 1, the sensor 7 detects the non-printable area AF, and the image indicating the image data assigned to one nozzle group NzG is printed by the other nozzle group NzG different from the one nozzle group NzG in printing with respect to the adjacent area RA.

The control program 121 executed by the control section 100 of the printer 1 causes the control section 100 to print the image indicated by the image data assigned to one nozzle group NzG by the other nozzle group NzG different from the one nozzle group NzG in printing with respect to the adjacent area RA.

According to the printer 1, the control method of the printer 1, and the control program 121, since the other nozzle group NzG alternately prints the image printed by the one nozzle group NzG, the image printing can be completed in the adjacent area RA. Therefore, it is possible to suppress occurrence of waste of the print medium W in the printed product obtained by printing on the print medium W that can come into contact with the print head 81.

In the printing with respect to the downstream adjacent area RA-K, the control section 100 prints the image indicated by the image data assigned to the downstream nozzle group NzG-K by the upstream nozzle group NzG-J in a state where the transport of the transport belt 4 is stopped after the most downstream nozzle group NzG prints an image in the downstream adjacent area RA-K in the transport direction H.

With this configuration, the image printing can be appropriately completed in the downstream adjacent area RA-K. Therefore, waste of the print medium W in the downstream adjacent area RA-K can be suppressed.

The control section 100 prints the image indicated by the image data assigned to the upstream nozzle group NzG-J by the downstream nozzle group NzG-K in printing with respect to the upstream adjacent area RA-J, and prints the image by the upstream nozzle group NzG-J and the downstream nozzle group NzG-K in a state where the transport of the transport belt 4 is stopped.

With this configuration, the image printing can be appropriately completed in the upstream adjacent area RA-J. Therefore, waste of the print medium W in the upstream adjacent area RA-J can be suppressed.

The control section 100 performs a plural times of multipass printing in which ink is discharged by the print head 81 with respect to the same raster line that extends in the intersecting direction K.

With this configuration, it is possible to perform printing while suppressing the waste of the print medium W in the printed product, and to increase the print resolution or the discharge amount of the ink IK.

The control section 100 prints the downstream adjacent area RA-K by the print head 81. Then, the control section 100 retracts the carriage 82 from the position where the print head 81 prints an image, and causes the transport belt 4 to transport the print medium W until the non-printable area AF is positioned downstream of the carriage 82 in the transport direction H. In addition, the control section 100 prints the upstream adjacent area RA-J by the print head 81.

With this configuration, it is possible to execute the printing while automatically avoiding the contact between the print head 81 and the print medium W. Therefore, the operator does not need to stop the printing operation of the printer 1 in order to avoid the contact between the print head 81 and the print medium W. Therefore, it is possible to suppress the waste of the print medium W in the printed product without deterioration of the productivity of the printer 1.

The control section 100 changes the height of the carriage 82 with respect to the print medium W such that the workpiece gap is greater than the workpiece gap during the printing, and the carriage 82 is retracted.

With this configuration, the print head 81 can be separated from the print medium W by retracting the carriage 82 by changing the height of the carriage 82 such that the workpiece gap is greater than the workpiece gap during the printing, and the contact between the print medium W and the print head 81 can be more reliably avoided.

The control section 100 causes the carriage 82 to scan up to beyond the printing area, which is an outer side of the printing area A2 for forming an image by discharging the ink IK onto the print medium W, and retracts the carriage 82.

With this configuration, the print head 81 can be prevented from being positioned on the print medium W by causing the carriage 82 to scan up to beyond the printing area and retracting the carriage 82, and the contact between the print medium W and the print head 81 can be more reliably avoided.

The sensor 7 is provided downstream of the placement start position I1 where the transport belt 4 starts the placement of the print medium W and upstream of the print head 81, in the transport direction H.

With this configuration, the sensor 7 can detect the non-printable area AF before the non-printable area AF reaches the print head 81, and can more reliably avoid the contact between the print head 81 and the print medium W.

The print medium W is a fabric. The non-printable area AF includes a seam Se of the fabric.

In general, the thickness of the print medium W differs depending on the print medium W or the fabric that forms the print medium W. Therefore, there is a possibility that the thickness of the seam Se is different for each seam Se even on the same print medium W. In this manner, even when the print medium W is a print medium W of which the thickness may differ depending on the seam Se, occurrence of waste of the print medium W in the printed product can be suppressed while avoiding the contact between the print head 81 and the print medium W without deterioration of the productivity of the printer 1.

The above-described embodiments illustrate one specific example to which the disclosure is applied, and the disclosure is not limited thereto.

For example, in the above-described embodiments, the number of passes in multi-pass printing is illustrated as two, but the number of passes may be three or more.

In a case of three passes or more, the print control section 112 stops the transport by the transport belt 4 after the nozzle group NzG that is the most downstream in the transport direction H among the divided nozzle groups NzG prints an image in the downstream adjacent area RA-K. Then, the print control section 112 performs processing of printing the image indicated by the image data assigned to the first nozzle group by the second nozzle group that is adjacent to the first nozzle group and is upstream of the first nozzle group in the transport direction, a number of times that corresponds to the number of passes. Further, for the upstream adjacent area RA-J, the print control section 112 performs processing of printing the image indicated by the image data assigned to the second nozzle group by the first nozzle group which is adjacent to the second nozzle group and is downstream of the second nozzle group in the transport direction H in a state where the transport of the transport belt 4 is stopped, a number of times that corresponds to the number of passes. Then, the print control section 112 performs printing by all the nozzle groups in a state where the transport is stopped, and returns to normal printing.

Note that the first nozzle group and the second nozzle group here do not mean a specific nozzle group NzG, but mean a case where a certain nozzle group NzG is the first nozzle group and an upstream nozzle group NzG adjacent to the certain nozzle group NzG is the second nozzle group.

In a case of three passes or more, the print control section 112 specifies a plurality of passes according to the number of passes in step SA8. Then, the print control section 112 generates a plurality of pieces of pass data in which the image data assignment is changed from the specified pass data among the plurality of passes, and performs printing by the printing section 101 while performing retracting processing based on the generated plurality of pass data.

For example, in the above-described embodiment, the sensor 7 is an optical sensor, but may be a camera or a contact sensor. Further, the sensor 7 may be a sensor capable of detecting the thickness of the seam Se.

For example, in the above-described embodiment, the non-printable area AF is described as an example of an area including the seam Se. However, the non-printable area AF may be, for example, an area including a place where the print medium W is in a floating state from the transport belt 4, that is, a place where the so-called floating of the print medium W occurs, and the reason that may cause the contact with the print head 81 in the non-printable area AF is not limited to the seam Se.

For example, in the above-described embodiment, the printer 1 that transports the print medium W wound in a roll shape and prints an image was described as an example, but the disclosure is not limited thereto. For example, the disclosure can be applied to a printing apparatus that performs printing by fixing and holding the print medium W such as a fabric to be printed and moving the print head 81 relative to the print medium W. For example, the disclosure may be applied to a so-called garment printer in which clothes or a sewing fabric is fixed as the print medium W and the ink is discharged onto the print medium W for printing. Further, the disclosure may be applied to a printing apparatus that performs printing on not only a fabric but also a knit fabric, paper, synthetic resin sheets, and the like.

Further, the application target of the disclosure is not limited to an apparatus used alone as a printing apparatus, and may be applied to an apparatus having a function other than printing, such as a multifunction machine having a copy function or a scan function or a POS terminal device.

The printer 1 may be an apparatus that uses the ink IK that is cured by irradiation with ultraviolet rays, and in this case, the printer 1 may be provided with an ultraviolet irradiation apparatus instead of the drying unit 9. Further, the printer 1 may be configured to include a cleaning apparatus that cleans the print medium W dried by the drying unit 9, and other detailed configurations of the printer 1 can be changed in any manner.

Further, each functional section of the control section 100 can be configured as the control program 121 executed by the processor 110 as described above, and additionally can be realized by a hardware circuit in which the control program 121 is incorporated. Further, the printer 1 may be configured to receive the control program 121 from a server apparatus or the like via a transmission medium.

The functions of the control section 100 may be realized by a plurality of processors or semiconductor chips.

Further, for example, the step unit of the operation illustrated in FIG. 6 is divided in accordance with the main processing content in order to make it easy to understand the operation of the printer 1, and thus, the disclosure is not limited by the division method or name of the processing unit. The step unit may be divided into a larger number of step units in accordance with the processing content. Further, one step unit may be divided so as to include more number of processing. Further, the order of the steps may be appropriately changed within a range that does not interfere with the gist of the disclosure.

What is claimed is:

1. A printing apparatus comprising:

a transport belt that transports a print medium;

a print head that has a plurality of nozzles for discharging ink and discharges the ink onto the print medium placed on the transport belt;

a carriage that mounts the print head thereon and scans in an intersecting direction that intersects a transport direction of the print medium;

a sensor that detects a non-printable area of the print medium where the print medium placed on the transport belt and the print head are configured to come into contact with each other; and a control section that performs printing by the print head by dividing the plurality of nozzles into a plurality of nozzle groups in the transport direction, wherein the control section prints an image indicated by image data assigned to one nozzle group by another nozzle group different from the one nozzle group, in printing with respect to an adjacent area which is an area of which a length in the transport direction corresponds to a length of a nozzle row in the transport direction of the print head, and is a printable area adjacent to the non-printable area detected by the sensor.

2. The printing apparatus according to claim 1, wherein the control section prints an image indicated by image data assigned to a first nozzle group by a second nozzle group which is adjacent to the first nozzle group and is upstream of the first nozzle group in the transport direction in a state where transport of the transport belt is stopped after the most downstream nozzle group in the transport direction prints an image in the adjacent area, in printing with respect to the adjacent area downstream of the non-printable area in the transport direction.

3. The printing apparatus according to claim 1, wherein the control section prints an image indicated by image data assigned to a second nozzle group by a first nozzle group which is adjacent to the second nozzle group and is downstream of the second nozzle group in the transport direction, and prints an image by the first nozzle group and the second nozzle group in a state where transport of the transport belt is stopped, in printing with respect to the adjacent area upstream of the non-printable area in the transport direction.

4. The printing apparatus according to claim 1, wherein the control section performs multi-pass printing in which ink is discharged by the print head a plurality of times with respect to the same raster line that extends in the intersecting direction.

5. The printing apparatus according to claim 1, wherein the control section prints the adjacent area downstream of the non-printable area in the transport direction by the print head, retracts the carriage from a position where the image is printed by the print head and causes the transport belt to transport the print medium until the non-printable area is positioned downstream of the carriage in the transport direction, and performs printing with respect to the adjacent area upstream of the non-printable area in the transport direction by the print head.

6. The printing apparatus according to claim 5, wherein the control section changes a height of the carriage with respect to the print medium such that a workpiece gap, which is a distance between the print medium and a nozzle surface of the print head, is greater than the workpiece gap during the printing, and retracts the carriage.

7. The printing apparatus according to claim 5, wherein the control section causes the carriage to scan up to beyond a printing area, which is an outer side of the printing area for printing an image by discharging the ink onto the print medium, and retracts the carriage.

8. The printing apparatus according to claim 1, wherein the sensor is provided downstream of a placement start position at which the transport belt starts placement of the print medium and upstream of the print head in the transport direction.

9. The printing apparatus according to claim 1, wherein the print medium is a fabric, and the non-printable area includes a seam of the fabric.

10. A control method of a printing apparatus including a transport belt that transports a print medium, a print head that has a plurality of nozzles for discharging ink and discharges the ink onto the print medium placed on the transport belt to print an image, and a carriage that mounts the print head thereon and scans in an intersecting direction that intersects a transport direction of the print medium, in which printing is performed by the print head by dividing the plurality of nozzles included in the print head into a plurality of nozzle groups in the transport direction, the method comprising:

detecting, by a sensor, a non-printable area of the print medium where the print medium placed on the transport belt and the print head are configured to come into contact with each other; and printing an image indicated by image data assigned to one nozzle group by another nozzle group different from the one nozzle group, in printing with respect to an adjacent area which is an area of which a length in the transport direction corresponds to a length of a nozzle row of the print head, and is a printable area adjacent to the non-printable area detected by the sensor in the transport direction.

11. A non-transitory computer-readable storage medium storing a program that is executed by a control section of a printing apparatus including a transport belt that transports a print medium, a print head that has a plurality of nozzles for discharging ink and discharges the ink onto the print medium placed on the transport belt to print an image, a carriage that mounts the print head thereon and scans in an intersecting direction that intersects a transport direction of the print medium, a sensor that detects a non-printable area of the print medium where the print medium placed on the transport belt and the print head are configured to come into contact with each other, and the control section that performs printing by the print head by dividing a plurality of nozzles included in the print head into a plurality of nozzle groups in the transport direction, the program causing the control section to print an image indicated by image data assigned to one nozzle group by another nozzle group different from the one nozzle group, in printing with respect to an adjacent area which is an area of which a length in the transport direction corresponds to a length of a nozzle row of the print head, and is a printable area adjacent to the non-printable area detected by the sensor in the transport direction.

* * * * *